US011761308B2

(12) United States Patent
Defretin et al.

(10) Patent No.: US 11,761,308 B2
(45) Date of Patent: Sep. 19, 2023

(54) RECONFIGURABLE FLOW IN DRILLING AND MEASUREMENTS TOOLS

(71) Applicant: Schlumberger Technology Corporation, Sugar Land, TX (US)

(72) Inventors: Harmel Defretin, Sugar Land, TX (US); Ahmed Morsy, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/247,588

(22) Filed: Dec. 17, 2020

(65) Prior Publication Data

US 2021/0189839 A1 Jun. 24, 2021

Related U.S. Application Data

(60) Provisional application No. 62/950,408, filed on Dec. 19, 2019.

(51) Int. Cl.

| | |
|---|---|
| ***E21B 41/00*** | (2006.01) |
| ***E21B 21/10*** | (2006.01) |
| ***E21B 43/12*** | (2006.01) |

(52) U.S. Cl.

CPC ..... *E21B 41/0085* (2013.01); *E21B 21/10* (2013.01); *E21B 21/103* (2013.01); *E21B 43/12* (2013.01)

(58) Field of Classification Search

CPC .... E21B 41/0085; E21B 21/103; E21B 43/12; E21B 21/10

See application file for complete search history.

(56) References Cited

U.S. PATENT DOCUMENTS

| | | | | |
|---|---|---|---|---|
| 2016/0017695 | A1* | 1/2016 | Delgado | E21B 4/02 175/57 |
| 2016/0145975 | A1* | 5/2016 | Carroll | H02K 7/1823 166/244.1 |
| 2016/0177773 | A1* | 6/2016 | Chochua | F01D 9/04 415/148 |
| 2016/0369591 | A1* | 12/2016 | Vachon | E21B 43/12 |
| 2017/0362953 | A1* | 12/2017 | Gatzen | E21B 41/0085 |
| 2018/0106137 | A1* | 4/2018 | Frosell | E21B 43/12 |

* cited by examiner

*Primary Examiner* — Brad Harcourt
(74) *Attorney, Agent, or Firm* — Trevor G. Grove

(57) ABSTRACT

The disclosure provides for systems and methods for controlling fluid flow into a power generation section of a tool string. In one aspect, multiple flow kits are fluidly coupled with a turbine, and flow of fluid into the turbine is regulated by selectively opening valves coupled with the flow kits. In another aspect, a valve is fluidly coupled with the turbine, and flow of fluid through the valve and into the turbine is regulated by opening, partially opening, closing, or partially closing the valve in response to measured operational parameter data.

7 Claims, 10 Drawing Sheets

RECONFIGURABLE FLOW IN DRILLING AND MEASUREMENTS TOOLS

CROSS-REFERENCE TO RELATED APPLICATIONS

The current application claims priority to U.S. Provisional Application 62/950,408, filed Dec. 19, 2019, the entirety of which is incorporated by reference.

FIELD OF THE DISCLOSURE

Aspects of the disclosure relate to methods, apparatus and systems for controlling fluid flow into a power generation system of a bottom hole assembly (BHA).

BACKGROUND

In oil and gas operations, drilling and measurement operations include power generation, which may be accomplished by flowing fluid into a turbine to drive the turbine that, in-turn, drives a generator. Flow into the turbine is controlled by a flow kit. Currently, during drilling and measurement operations, it is necessary to transport the tool string or BHA from the jobsite to a base site that is remote from the jobsite so that the flow kit of the tool string or BHA can be retrofitted for use in different jobs. Such transportation increases downtime, contributing to lower tool utilization. It would be desirable to avoid such downtime for retrofitting.

SUMMARY

One embodiment of the present disclosure includes a method for controlling fluid flow into a power generation section of a tool string. The method includes providing multiple flow kits that are fluidly coupled with a turbine. The multiple flow kits include at least a first flow kit and a second flow kit. A valve is coupled with each flow kit. The method includes regulating flow of fluid into the turbine by opening the valve coupled with the first flow kit and maintaining the valve coupled with the second flow kit closed, such that the fluid flows through the first flow kit and into the turbine. The turbine is coupled with and drives a generator, and the generator generates electricity.

Another embodiment of the present disclosure includes a method for controlling fluid flow into a power generation section of a tool string. The method includes providing a valve that is fluidly coupled with a turbine. The turbine is coupled with a generator. The method includes flowing fluid through the valve and into the turbine. The fluid drives the turbine, the turbine drives the generator, and the generator generates electricity. The method includes measuring an operational parameter downstream of the valve. The operational parameter is fluid flow rate or an operational parameter that is responsive to fluid flow rate. The method includes regulating flow of fluid through the valve and into the turbine by opening, partially opening, closing, or partially closing the valve in response to the measured operational parameter.

Another embodiment of the present disclosure includes a system for controlling fluid flow into a power generation section of a tool string. The system includes a turbine coupled with a generator, and multiple flow kits fluidly coupled with the turbine. The multiple flow kits include at least a first flow kit and a second flow kit, and a valve is coupled with each flow kit. A valve controller is coupled with each valve. The valve controller is configured to open and close each valve for regulating flow of fluid into the turbine.

Another embodiment of the present disclosure includes a system for controlling fluid flow into a power generation section of a tool string. The system includes a turbine coupled with a generator, and a valve fluidly coupled with the turbine. A sensor is positioned to measure an operational parameter downstream of the valve. The operational parameter is fluid flow rate or an operational parameter that is responsive to fluid flow rate. A valve controller is coupled with each valve and with the sensor, and the valve controller is configured to open, partially open, close, or partially close the valve for regulating flow of fluid into the turbine in response to data from the sensor.

Another embodiment of the present disclosure includes a system for controlling fluid flow into a power generation section of a tool string. The system includes a computer readable storage medium. Processor-executable instructions are stored in the computer readable storage medium to instruct a processor to open, partially open, close, or partially close a valve for regulating flow of fluid into a turbine in response to data from a sensor.

BRIEF DESCRIPTION OF THE DRAWINGS

So that the manner in which the features of the apparatus, systems and methods of the present disclosure may be understood in more detail, a more particular description is provided with reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Methods, apparatus, and systems according to present disclosure will now be described more fully with reference to the accompanying drawings, which illustrate various exemplary embodiments.

DETAILED DESCRIPTION

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1A:
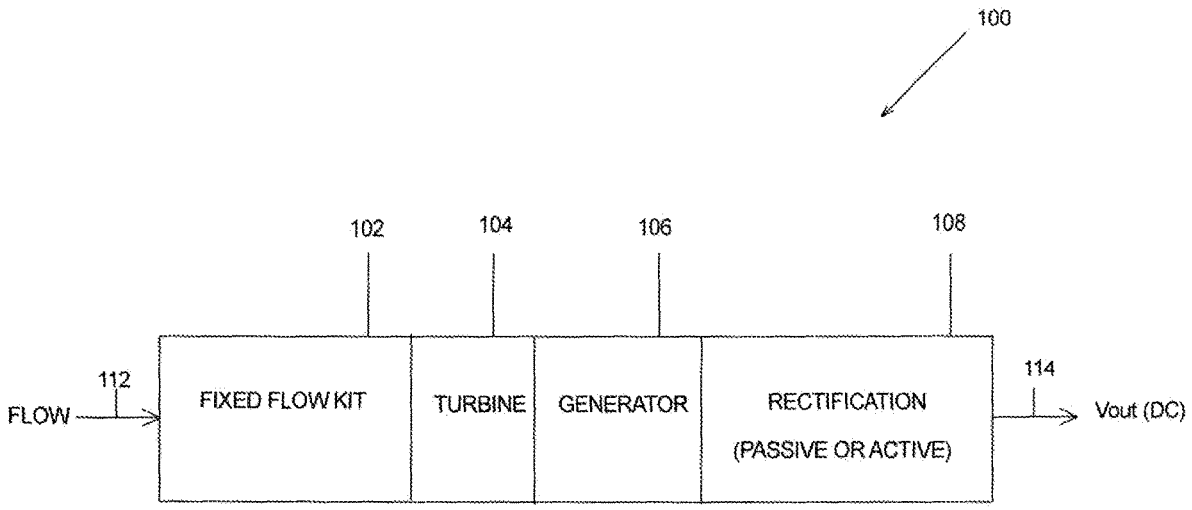
FIG. 1A is a schematic of a prior art system for controlling flow to a turbine, where the tool string needs to be removed and serviced if the flow kit needs to be changed before the next project.
Figure 1B:
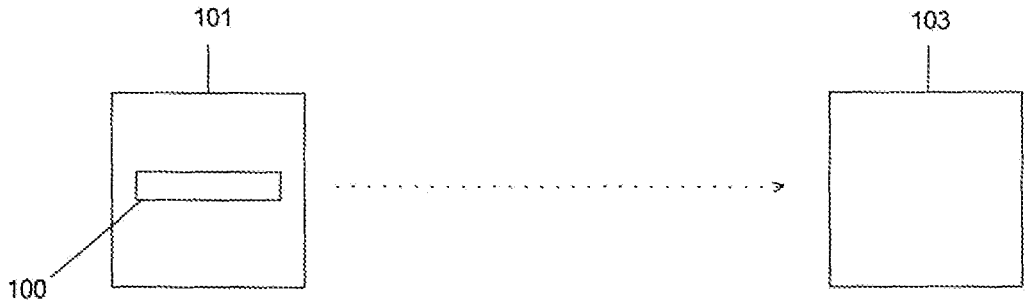
FIG. 1B is a schematic of a jobsite.

The present disclosure includes methods, systems, and apparatus for controlling fluid flow into a power generation system of a tool string. By controlling the fluid flow into the power generation system, the methods, systems, and apparatus disclosed herein, in-turn, control the power generated by the power generation system. With reference to FIG. 1A, power generation section 100 of a tool string is shown. Power generation section 100 includes fixed flow kit 102. Fixed flow kit 102 is installed onto power generation section 100 prior to operations at the jobsite. Fixed flow kit 102 is coupled with turbine 104, turbine 104 is coupled with generator 106, and generator 106 is coupled with rectification component 108. As fluid flow 112 enters fixed flow kit 102, fix flow kit 102 directs fluid flow 112 into turbine 104. Turbine 104 is driven by fluid flow 112. Driven turbine 104 drives generator 106, such that generator 106 produces electricity. The electricity produced by generator 106 is provided to rectification component 108, which may be a passive or active rectification component. Rectification component 108 converts AC voltage from generator to DC voltage 114. The DC voltage 114 may be provided to a downhole tool to power the downhole tool, such as a drilling and measurement tool. When power needs to be provided to a different downhole tool that requires different flow characteristics into the generator (i.e., a different flow kit) for the next job, then it is necessary to retrieve power generation section 100 from downhole and transport the BHA to another location for retrofitting and servicing thereof. Thus, in such current tool configurations of the power generation section of a tool string, as shown in FIG. 1A, the flow kit does not provide sufficient flexibility to complete multiple, different jobs without requiring removal and transport from jobsite 101 to another location 103 for retrofitting and service, as shown in FIG. 1B. To accommodate job requirements with various flow rates, such current tool configurations are shipped back to a base site to change the flow kit, which requires opening the tool string for retrofitting thereof.

The present disclosure provides for methods, systems, and apparatus for selectively controlling fluid flow into a power generation section of a tool string to selectively provide fluid into the power generation section at a selected flow rate. The power generation section may include a turbine coupled with a generator. In some such embodiments, the methods, systems, and apparatus disclosed herein provide for the control and/or redirection of fluid flow into the turbine at a selected fluid flow rate. In some such embodiments, flow apparatus are provided in the power generation section of the tool string, where the flow apparatus is reconfigurable into multiple different configurations, where each configuration provides a different flow rate of fluid to the power generation section. In some such embodiments, the flow apparatus includes multiple flow kits integrated into the power generation section, including multiple valves that are selectively controllable to select one of the multiple flow kits for use in providing fluid into the power generation section. In some such embodiments, each of the multiple flow kits is configured to provide a different flow rate into the power generation section than the other flow kits of the multiple flow kits. In other embodiments, a valve is used to control the flow rate of fluid into the power generation section, where the control of the flow rate of the fluid is responsive to sensor data, providing for pseudo-active regulation of the fluid flow rate. For example, in some embodiments, the sensor data includes flow rate meter data, turbine revolutions per minute (rpm) data, generator voltage output data, or combinations thereof. Thus, some embodiments include a reconfigurable fluid flow apparatus that is reconfigurable to provide multiple different flow rates of fluid into the power generation section. The methods, systems, and apparatus provide for reconfiguring the fluid flow rate into the power generation section without having the remove and transport the power generation section to another location (e.g., a base site) for retrofitting and servicing.

In some such embodiments, the power generation section provides power to one or more drilling and measurement tools of a BHA. The BHA is the lower portion of the drill string, and can include, from the bottom up in a vertical well, the drill bit, a bit sub, a mud motor, stabilizers, a drill collar, drill pipe, jarring devices, and crossovers, for example. The BHA can also include directional drilling and measuring equipment, measurements-while-drilling tools, and logging-while-drilling tools. The power generation section can provide electrical power to one or more of the drilling and measuring components of the BHA.

Multiple Flow Kits

Figure 2A:
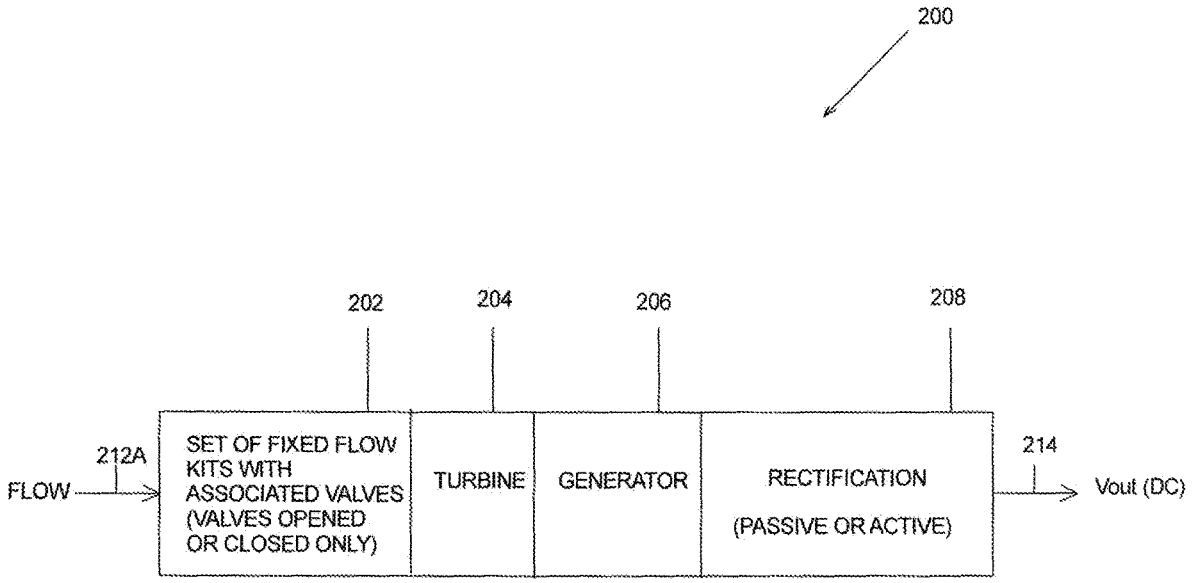
FIG. 2A is a schematic of a power generation section of a tool string in accordance with one example embodiment of the present disclosure that includes multiple flow kits that are accessible using a set of valves, such that flow can be directed to the desired flow kit.
Figure 2B:
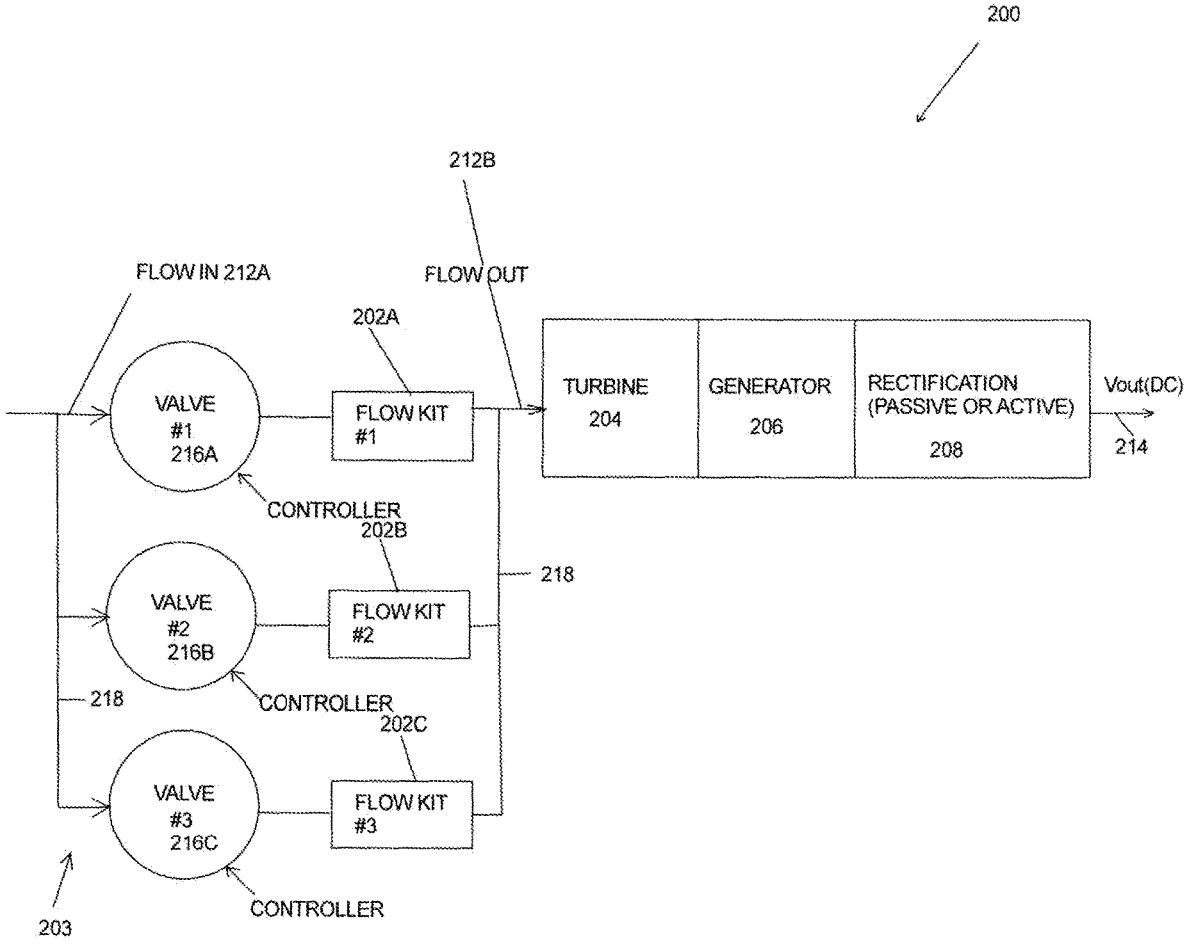
FIG. 2B is another schematic of a power generation section of a tool string in accordance with the present disclosure that includes multiple flow kits that are accessible using a set of valves, such that flow can be directed to the desired flow kit.

In some embodiments, multiple flow kits are included in the power generation section of the tool string to provide for control of the fluid flow rate into the power generation section. With reference to FIGS. 2A and 2B, power generation section 200 of a tool string is shown, in accordance with the present disclosure. Power generation section 200 includes a set of flow kits 203. The set of flow kits 203 includes multiple flow kits 202A-202C, each with an associated valve 216A-216C. Each of the valves 216A-216C is capable of at least two positions, including an opened position where fluid flow 212A is allowed to pass through the valve, and a closed position where fluid flow 212A is prevented from passing through the valve. In some embodiments, the valves 216A-216C are only capable of two positions, opened or closed. Set of flow kits 203 may be installed onto power generation section 200 prior to operations at the jobsite. Set of flow kits 203 is coupled with turbine 204 via conduits 218, turbine 204 is coupled with generator 206, and generator 206 is coupled with rectification component 208.

Fluid flow 212A enters set of flow kits 203 and passes therethrough via a pathway determined by which of valves 216A-216C are opened and which are closed. The fluid flow 212B that does pass through flow kits 203 is directed into turbine 204. Turbine 204 is driven by fluid flow 212B. Driven turbine 204 drives generator 206, such that generator 206 produces electricity. The electricity produced by generator 206 is provided to rectification component 208, which may be a passive or active rectification component. Rectification component 208 converts AC voltage from generator 206 into DC voltage 214. The DC voltage 214 may be provided to a downhole tool to power the downhole tool, such as a drilling and measurement tool.

In some embodiments, fluid flow 212A is only allowed to pass through one of the valves 216A-216C at a time. In other embodiments, fluid flow 212A is allowed to pass through multiple of the valves 216A-216C at one time. Each valve, or each distinct combination of valves, when opened, is configured to provide a selected flow rate of fluid flow 212B into turbine 204. When valve 216A is opened, fluid flow 212A flows through flow kit 202A and exits as fluid flow 212B. When valve 216B is opened, fluid flow 212A flows through flow kit 202B and exits as fluid flow 212B. When valve 216C is opened, fluid flow 212A flows through flow kit 202C and exits as fluid flow 212B. For example, to provide power for a first BHA tool, valve 216A is opened and valves 216B and 216C are closed; to provide power for a second BHA tool, valve 216B is opened and valves 216A and 216C are closed; and to provide power for a third BHA tool, valve 216C is opened and valves 216A and 216B are closed. In some embodiments, to provide power for a fourth BHA tool, valves 216A and 216B are opened and valve 216C is closed; to provide power for a fifth BHA tool, valves 216A and 216C are opened and valve 216B is closed; and to provide power for a sixth BHA tool, valves 216B and 216C are opened and valve 216A is closed. As such, when power needs to be provided to a different downhole tool that requires different flow characteristics into the generator (i.e., a different flow kit) for the next job, then a different valve, or different combination of valves, is placed into the opened configuration to provide the fluid flow 212B into turbine 204. By providing the fluid flow 212*a* through a different valve or combination of valves, the flow rate provided into the turbine 204 can be varied, which, in-turn, varies the voltage output 214 of the power generation section 200. As such, use of the valves 216A-216C provides for varying the flow rate of fluid flow 212B into the power generation section 200 and varying the voltage output 214 from the power generation section 200 without having to retrieve the power generation section 200 from downhole and transport the power generation section 200 to another location for retrofitting and servicing thereof. Thus, power generation section 200, with the set of flow kits 203 having multiple valves 216A-216C, provides sufficient flexibility to complete multiple, different jobs without requiring removal and transport to another location for retrofitting and service. That is, the valves 216A-216C allow the fluid flow 212A to be directed to the appropriate flow kit for the particular job or tool. While power generation section 200 is shown as including three flow kits 202A-202C, the power generation sections disclosed herein are not limited to having three flow kits, and may include less than three flow kits (e.g., two flow kits) or more than three flow kits. In some embodiments, each flow kit 202A-202C is different than other flow kits in the set of flow kits 203. For example, each flow kit 202A-202C may provide fluid flow 212B at a different flow rate into turbine 204.

Figure 2C:
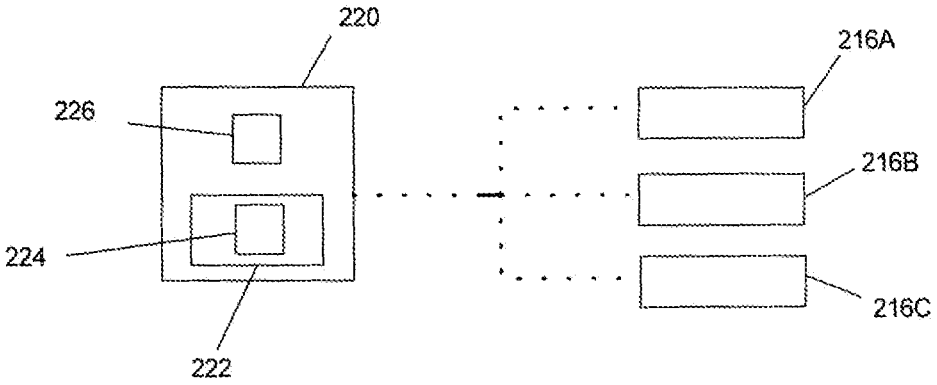
FIG. 2C is a schematic of a valve controller for controlling the valves of multiple flow kits.

In dynamic conditions, such as at power-up of the power generation section 200 and as the flow rate increases in the well, the set of flow kits may be dynamically configured and reconfigured to optimize the flow rate of fluid flow 212B into the turbine 204. With reference to FIG. 2C, valve controller 220 is shown in data communication with each of valves 216A-216C. Valve controller 220 controls the opening and closing of valves 216A-216C. While valve controller 220 is shown as being separate from valves 216A-216C, valve controller may be integrated and/or coupled with valves 216A-216C. Valve controller 220 may be, for example and without limitation, a computer having a processor 226 in communication with a computer readable storage medium 222 (e.g., a non-transitory storage medium). The computer readable storage medium 222 may have processor-executable instructions 224 stored therein for instructing the processor 226. For example, the processor-executable instructions 224 may include processor-executable instructions to instruct the processor 226 to open or close each of valves 216A-216C. For example, and without limitation, the valve controller 220 can be a programmed logic controller (PLC).

Pseudo-Active Regulation

Figure 3A:
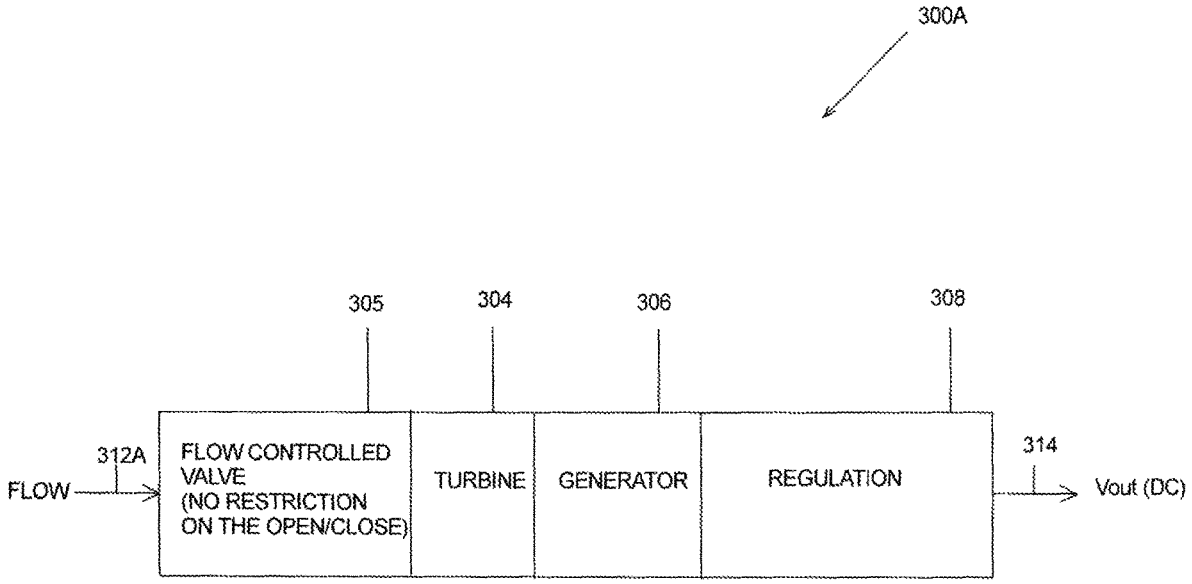
FIG. 3A is a schematic of a power generation section of a tool string in accordance with the present disclosure that includes a valve to control flow rate to the turbine, where a control loop is used to control the flow rate, turbine speed, or DC bus voltage.

In some embodiments, a valve that is controllable in response to feedback data is included in the power generation section of the tool string to provide for control of the fluid flow rate into the power generation section. With reference to FIG. 3A, power generation section 300A of a tool string is shown, in accordance with the present disclosure. Power generation section 300A includes a valve, flow-controlled valve 305. In some embodiments, power generation section 300A does not include a flow kit. Flow-controlled valve 305 may be installed onto power generation section 300A prior to operations at the jobsite. Flow-controlled valve 305 is fluidly coupled with turbine 304, turbine 304 is coupled with generator 306, and generator 306 is coupled with regulation component 308. As fluid flow 312A enters flow-controlled valve 305, flow-controlled valve 305 directs the fluid flow into turbine 304. Turbine 304 is driven by the fluid flow. Driven turbine 304 drives generator 306, such that generator 306 produces electricity. The electricity produced by generator 306 is provided to regulation component 308, which may be a pseudo-active regulation component. Pseudo-active regulation component 308 converts AC voltage from generator to DC voltage 314. The DC voltage 314 may be provided to a downhole tool to power the downhole tool, such as a drilling and measurement tool. When power needs to be provided to a different downhole tool that requires different flow characteristics into the generator 306 (i.e., a different flow kit) for the next job, then the percent that flow-controlled valve 305 is opened may be changed. For example, if the flow-controlled valve 305 is halfway opened (i.e., 50% opened) for a first job, and a second job requires the flow-controlled valve 305 to be 75% opened, then the flow-controlled valve 305 can be opened from a configuration where it is 50% opened to a configuration where it is 75% opened for the second job. As used herein, a 0% opening of the valve refers to a position and/or configuration of the valve where the valve is fully closed, a 100% opening of the valve refers to a position and/or configuration of the valve where the valve is fully opened, and percentages of valve opening between 0% and 100% are, correspondingly, partially opened valve positions. Thus, with use of the flow-controlled valve 305, the fluid flow provided to the power generation section 300A can be modified without removing the power generation section 300A from downhole and transporting the power generation section 300A to another location for retrofitting and servicing thereof. That is, power generation sections including the flow-controlled valve 305 disclosed herein provide sufficient flexibility to complete multiple, different jobs without requiring removal and transport from a jobsite to another location for retrofitting and service.

In some embodiments, an operational parameter downstream of the valve is measured, and the valve 305 is controlled in response to the measured operational parameter. The operational parameter may be fluid flow rate into the turbine, or may be an operational parameter that is responsive to fluid flow rate. As used herein, an "operation parameter that is responsive to fluid flow rate" is a parameter of the power generation section that exhibits a change when the flow rate is changed. For example, and without limitation, the rpm of the turbine changes with changing flow rate and the voltage output of the generator changes with changing flow rate. Thus, rpm of the turbine and voltage output of the generator are examples of operation parameters that are responsive to fluid flow rate. In some embodiments, the flow-controlled valve 305 disclosed herein is responsive to operational data of components positioned downstream of flow-controlled valve 305. For example, flow-controlled valve 305 can be controlled in response to: 1) measurement data from a flow meter positioned downstream of flow-controlled valve 305; (2) measurement data indicative of the turbine speed (rpm) of the turbine 304; or (3) measurement data from a volt meter positioned to measure a DC bus voltage. The flow-controlled valve 305 may be arranged in a feedback control loop with sensors positioned downstream of the flow-controlled valve 305. As such, flow-controlled valve 305 is arranged in a control loop to provide pseudo active regulation of the power generation section by directly or indirectly controlling the flow rate into the turbine 304, the turbine speed (RPM) of the turbine 304, or the tool DC bus voltage. Flow-controlled valve 305 may be electronically controlled in response to such flow, rpm, or voltage data to fully open, fully close, partially open, or partially close.

Figure 3B:
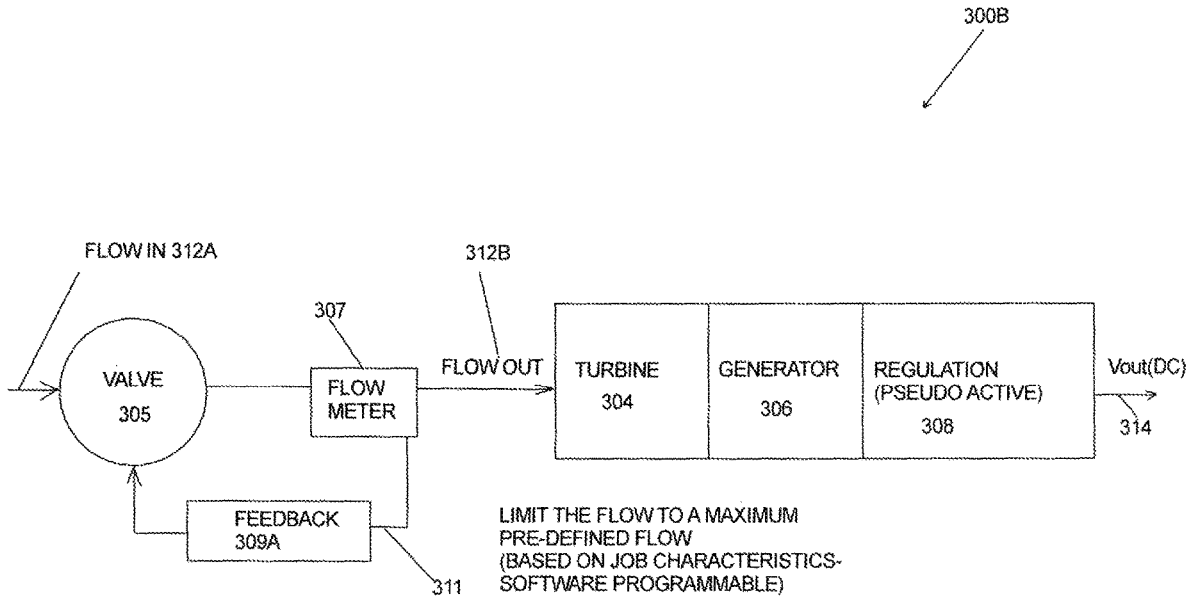
FIG. 3B is a schematic of a power generation section of a tool string in accordance with an example embodiment of the present disclosure that includes a valve to control flow rate to the turbine, where a control loop is used to control the valve using data from a flow rate meter.

With reference to FIG. 3B, an embodiment of the power generation section that includes a flow-controlled valve arranged in a feedback control loop with a flow meter is depicted. Power generation section 300B is substantially the same as power generation section 300A of FIG. 3A, but depicts additional components, including flow meter 307 in communication with flow-controlled valve 305 via feedback control loop 309A.

Flow-controlled valve 305 is fluidly coupled with flow meter 307, which is positioned between flow-controlled valve 305 and turbine 304. Flow meter 307 measures the flow rate of fluid passing therethrough and to turbine 304. Flow meter 307 transmits flow meter measurement data 311 to flow-controlled valve 305 via feedback control loop 309A. Fluid flow 312A passes through flow-controlled valve 305, then through flow meter 307, and then into turbine as fluid flow 312B. As the fluid passes through flow meter 307, flow meter 307 measures the flow rate of the fluid therethrough. Flow meter 307 is in wired and/or wireless communication with flow-controlled valve 305 to transmit flow meter data 311 thereto. Feedback control loop 309A compares the measured flow rate from data 311 to a target flow rate. The target flow rate may be a pre-defined flow rate or maximum flow rate, which may vary based on the specific characteristics of the job being performed. For example, if the measured flow rate is higher than a target or maximum flow rate, then the feedback control loop 309A may instruct the flow-controlled valve 305 to close or at least partially close in order to reduce the flow rate. If the measured flow rate is lower than a target or minimum flow rate, then the feedback control loop 309A may instruct the flow-controlled valve 305 to open or at least partially open in order to increase the flow rate.

Figure 3C:
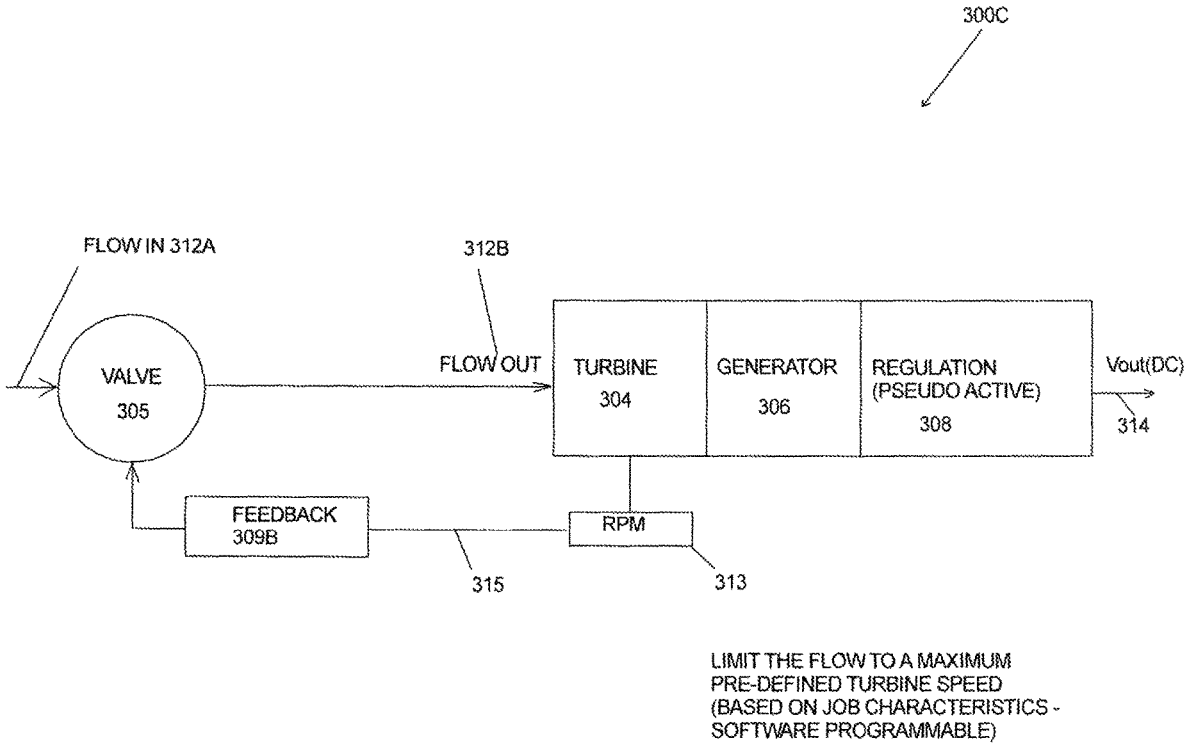
FIG. 3C is a schematic of a power generation section of a tool string in accordance with an example embodiment of the present disclosure that includes a valve to control flow rate to the turbine, where a control loop is used to control the valve using rpm data from a turbine.

With reference to FIG. 3C, an embodiment of the power generation section that includes a flow-controlled valve arranged in a feedback control loop with turbine speed is depicted. Power generation section 300C is substantially the same as power generation section 300A of FIG. 3A, but depicts additional components, including rpm meter 313 coupled with turbine 304 and in communication with flow-controlled valve 305 via feedback control loop 309B.

Rpm meter 313 is positioned to measure the rpm of turbine 304. Rpm meter 313 transmits rpm meter measurement data 315 to flow-controlled valve 305 via feedback control loop 309B. Fluid flow 312A passes through flow-controlled valve 305 and into turbine 304 as fluid flow 312B. As turbine 304 is driven, rpm meter 313 measures the rpm of turbine 304. Rpm meter 313 is in wired and/or wireless communication with flow-controlled valve 305 to transmit rpm meter data 315 thereto. Feedback control loop 309B compares the measured rpm rate from data 315 to a target rpm. The target rpm may be a pre-defined rpm or maximum rpm, which may vary based on the specific characteristics of the job being performed. For example, if the measured rpm is higher than a target or maximum rpm, then the feedback control loop 309B may instruct the flow-controlled valve 305 to close or at least partially close in order to reduce the rpm. If the measured rpm is lower than a target or minimum rpm, then the feedback control loop 309B may instruct the flow-controlled valve 305 to open or at least partially open in order to increase the rpm.

Figure 3D:
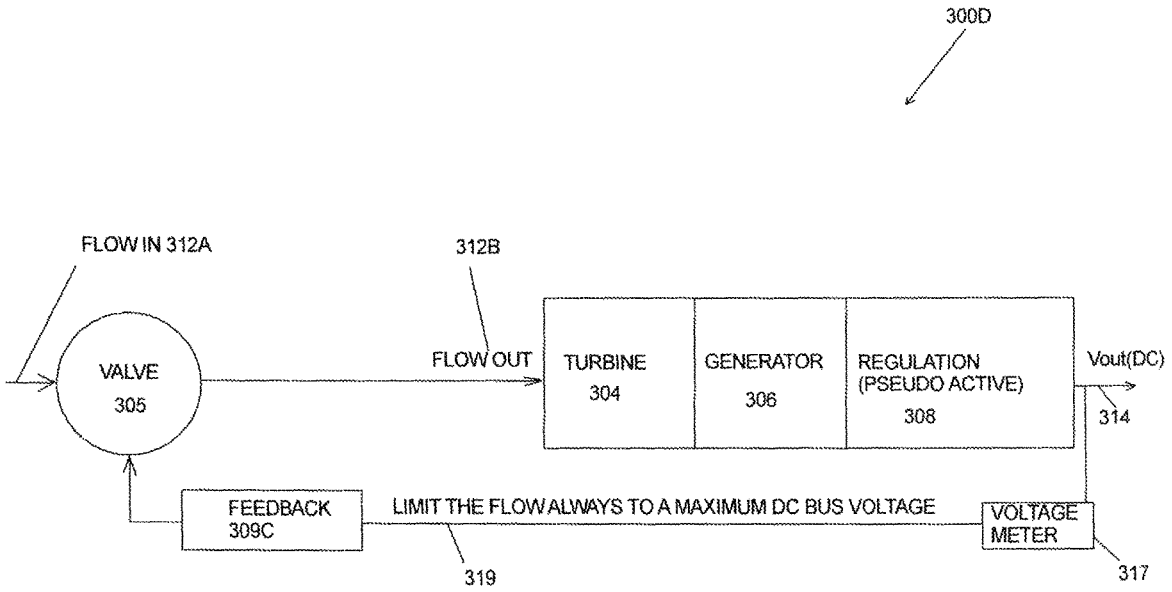
FIG. 3D is a schematic of a power generation section of a tool string in accordance with an example embodiment of the present disclosure that includes a valve to control flow rate to the turbine, where a control loop is used to control the valve using data from a voltage meter at the output of the power generation section.

With reference to FIG. 3D, an embodiment of the power generation section that includes a flow-controlled valve arranged in a feedback control loop with DC bus voltage is depicted. Power generation section 300D is substantially the same as power generation section 300A of FIG. 3A, but depicts additional components, including voltage meter 317 coupled with the voltage output 314 of the power generation section 300D and in communication with flow-controlled valve 305 via feedback control loop 309C.

Voltage meter 317 is positioned to measure the voltage output 314 of the power generation section 300D. Voltage meter 317 transmits voltage meter measurement data 319 to flow-controlled valve 305 via feedback control loop 309C. Fluid flow 312A passes through flow-controlled valve 305 and into turbine 304 as fluid flow 312B. As turbine 304 is driven and generator 306 produces electricity, the voltage meter 317 measures the voltage output 314. Voltage meter 317 is in wired and/or wireless communication with flow-controlled valve 305 to transmit voltage meter data 319 thereto. Feedback control loop 309C compares the measured voltage from data 319 to a target, maximum voltage. The target maximum voltage may be a pre-defined maximum voltage, which may vary based on the specific characteristics of the job being performed. For example, if the measured voltage is higher than a target maximum voltage, then the feedback control loop 309C may instruct the flow-controlled valve 305 to close or at least partially close in order to reduce the voltage. If the measured rpm is lower than a target minimum voltage, then the feedback control loop 309C may instruct the flow-controlled valve 305 to open or at least partially open in order to increase the voltage. The embodiment of FIG. 3D eliminates the need for flow kit retrofitting and also provides the ability to regulate the tool DC bus voltage and to introduce pseudo-active regulation into the power generation section. The pseudo-active regulation narrows the bus voltage propagated through the tool, and simplifies the design of each power supply (i.e., narrowing the power supply input voltage makes the power supply design simpler and generally provides higher power supply efficiency). Thus, active DC bus regulation, also referred to as pseudo-active regulation, is provided for in the present disclosure, such that there is no need to electrically boost the DC bus as is done in traditional active rectification methods. While not shown, in some embodiments a second valve, or equivalent component, is incorporated into the power generation section to redirect excess flow into the well (e.g., to manage the case when the turbine flow-in is different from the turbine flow-out).

Figure 3E:
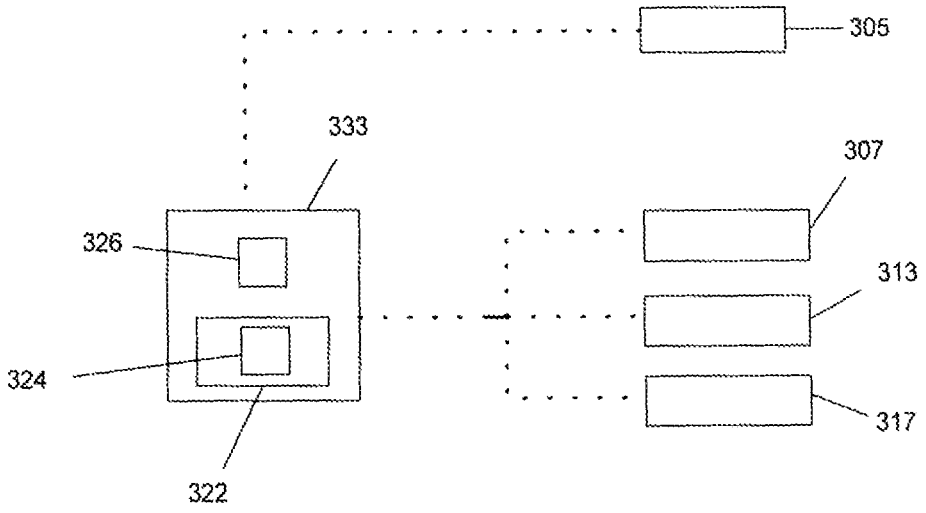
FIG. 3E is a schematic of a valve controller for controlling a valve that is responsive to operational parameters.

With reference to FIG. 3E, in some embodiments valve controller 333 may be or include feedback control loop 309 and/or software or firmware to implement the feedback control loop 309. Valve controller 333 may be a PLC, for example. Valve controller 333 may be or include a computer with a processor 326, computer readable storage medium 322 (e.g., non-transitory storage medium), and processor-executable instructions 324 stored in the computer readable storage medium 322. Valve controller 333 is in data communication with one or more sensors associated with the flow meters, rpm meters and voltage meters, 307, 313, and 317, for receipt of sensor data therefrom. Valve controller 333 is in communication with flow-controlled valve 305 for transmission of control commands thereto. For example, valve controller 333 may instruct flow-controlled valve 305 to fully open, fully close, partially open, or partially close in response to the sensor data.

The processor-executable instructions 324 may include processor-executable instructions that instruct the processor 326 to receive sensor data from sensors associated with the flow meters, rpm meters and voltage meters 307, 313, and/or 317. The processor-executable instructions 324 may include processor-executable instructions that instruct the processor 326 to store sensor data from sensors within the computer readable storage medium 322. The processor-executable instructions 324 may include processor-executable instructions that instruct the processor 326 to compare sensor data to from sensors associated with the flow meters, rpm meters and voltage meters 307, 313, and/or 317 to target limits stored in the computer readable storage medium 322. For example, the processor-executable instructions 324 may include processor-executable instructions that instruct the processor 326 to compare a measured flow rate, rpm, or voltage to a target (maximum or minimum) flow rate, rpm, or voltage. The processor-executable instructions 324 may include processor-executable instructions that instruct the processor 326 to fully open, partially open, fully close, or partially close the flow-controlled valve 305 in response to the comparison between the measured sensor data and the target parameters (e.g., target flow rate, rpm, or voltage). For example, if the flow rate, rpm, or voltage is higher than the target, then the processor-executable instructions may instruct the processor 326 to partially close the valve to reduce the flow rate, rpm, or voltage.

EMBODIMENTS

Certain embodiments of the present disclosure will now be set forth.

Embodiment 1. A method for controlling fluid flow into a power generation section of a tool string, the method including: providing multiple flow kits that are fluidly coupled with a turbine, the multiple flow kits including at least a first flow kit and a second flow kit, wherein a valve is coupled with each flow kit; regulating flow of fluid into the turbine by opening the valve coupled with the first flow kit and maintaining the valve coupled with the second flow kit closed, such that the fluid flows through the first flow kit and into the turbine; wherein the turbine is coupled with and drives a generator, and wherein the generator generates electricity.

Embodiment 2. The method of embodiment 1, further including passing the electricity generated by the generator through an active or passive rectification component to convert alternating current from the generator to direct current.

Embodiment 3. The method of embodiment 2, further comprising providing the direct current to a drilling or measurement tool of a bottom hole assembly.

Embodiment 4. The method of any of embodiments 1 to 3, wherein the multiple flow kits include at least three flow kits.

Embodiment 5. The method of any of embodiments 1 to 4, wherein the multiple flow kits are arranged in parallel.

Embodiment 6. The method of any of embodiments 1 to 5, further including closing the valve coupled with the first flow kit and opening the valve coupled with the second flow kit, such that the fluid flows through the second flow kit and into the turbine.

Embodiment 7. The method of embodiment 6, wherein the first flow kit provides fluid into the turbine at a first flow rate when the valve coupled with the first flow kit is opened, wherein the second flow kit provides fluid into the turbine at a second flow rate when the valve coupled with the second flow kit is opened, and wherein the first flow rate is different than the second flow rate.

Embodiment 8. The method of embodiment 7, wherein, when the first flow kit provides fluid into the turbine at the first flow rate, the electricity generated by the generator is converted to direct current and provided to a first drilling or measurement tool of a bottom hole assembly; and wherein when the second flow kit provides fluid into the turbine at the second flow rate, the electricity generated by the generator is converted to direct current and provided to a second drilling or measurement tool of the bottom hole assembly.

Embodiment 9. A method for controlling fluid flow into a power generation section of a tool string, the method including: providing a valve that is fluidly coupled with a turbine, the turbine coupled with a generator; flowing fluid through the valve and into the turbine, wherein the fluid drives the turbine, wherein the turbine drives the generator, and wherein the generator generates electricity; measuring an operational parameter downstream of the valve, wherein the operational parameter is fluid flow rate or an operational parameter that is responsive to fluid flow rate; and regulating flow of fluid through the valve and into the turbine by opening, partially opening, closing, or partially closing the valve in response to the measured operational parameter.

Embodiment 10. The method of embodiment 9, wherein the operational parameter is fluid flow rate measured by a flow meter that is positioned between the valve and the turbine.

Embodiment 11. The method of embodiment 10, wherein the flow of fluid through the valve is regulated to maintain the fluid flow rate at or below a preset fluid flow rate.

Embodiment 12. The method of any of embodiments 9 to 11, wherein the operational parameter is revolutions per minute of the turbine.

Embodiment 13. The method of embodiment 12, wherein the flow of fluid through the valve is regulated to maintain the revolutions per minute of the turbine at or below a preset limit of revolutions per minute.

Embodiment 14. The method of any of embodiments 9 to 11, wherein the operational parameter is voltage measured by a voltage meter that is positioned at a voltage output of the generator, wherein the voltage output of the generator includes a voltage regulation component that converts AC current of the generator to DC current.

Embodiment 15. The method of embodiment 14, wherein the flow of fluid through the valve is regulated to maintain the voltage at or below a preset voltage.

Embodiment 16. The method of any of embodiments 9 to 17, wherein the valve arranged in a feedback control loop with sensors that are positioned downstream of the valve.

Embodiment 17. The method of embodiment 16, wherein the sensors include sensors positioned to measure fluid flow rate into the turbine, rpm of the turbine, or voltage generated by the generator.

Embodiment 18. The method of any of embodiments 9 to 17, further comprising directing excess fluid flow through a second valve and into a wellbore.

Embodiment 19. The method of any of embodiments 9 to 18, further comprising converting AC current generated by the generator into DC current, and providing direct current from to a drilling or measurement tool of a bottom hole assembly.

Embodiment 20. A system for controlling fluid flow into a power generation section of a tool string, the system including: a turbine coupled with a generator; multiple flow kits fluidly coupled with the turbine, the multiple flow kits including at least a first flow kit and a second flow kit, wherein a valve is coupled with each flow kit; and a valve controller coupled with each valve, wherein the valve controller is configured to open and close each valve for regulating flow of fluid into the turbine.

Embodiment 21. The system of embodiment 20, further including an active or passive rectification component positioned to receive electricity generated by the generator through an active or passive rectification component and convert alternating current from the generator to direct current.

Embodiment 22. The system of embodiment 21, further including a drilling or measurement tool of a bottom hole assembly positioned to receive the direct current.

Embodiment 23. The system of any of embodiments 20 to 22, wherein the multiple flow kits include at least three flow kits.

Embodiment 24. The system of any of embodiments 20 to 23, wherein the multiple flow kits are arranged in parallel.

Embodiment 25. The system of any of embodiments 20 to 24, wherein the first flow kit is configured to provide fluid into the turbine at a first flow rate when the valve coupled with the first flow kit is opened, wherein the second flow kit is configured to provide fluid into the turbine at a second flow rate when the valve coupled with the second flow kit is opened, and wherein the first flow rate is different than the second flow rate.

Embodiment 26. The system of any of embodiments 20 to 25, wherein the valve controller comprises a processor in communication with a computer readable storage medium, and processor-executable instructions stored in the computer readable storage medium.

Embodiment 27. The system of embodiment 26, wherein the processor-executable instructions include processor-executable instructions to instruct the processor to open or close each valve.

Embodiment 28. A system for controlling fluid flow into a power generation section of a tool string, the system including: a turbine coupled with a generator; a valve fluidly coupled with the turbine; a sensor positioned to measure an operational parameter downstream of the valve, wherein the operational parameter is fluid flow rate or an operational parameter that is responsive to fluid flow rate; and a valve controller coupled with each valve and with the sensor, wherein the valve controller is configured to open, partially open, close, or partially close the valve for regulating flow of fluid into the turbine in response to data from the sensor.

Embodiment 29. The system of embodiment 28, wherein the sensor is a flow meter positioned between the valve and the turbine, and wherein the operational parameter is fluid flow rate measured by the flow meter.

Embodiment 30. The system of embodiment 29, wherein the valve controller is configured to regulate the flow of fluid through the valve to maintain the fluid flow rate at or below a preset fluid flow rate.

Embodiment 31. The system of any of embodiments 28 to 30, wherein the sensor is positioned to measure revolutions per minute of the turbine, and wherein the operational parameter is rpm of the turbine.

Embodiment 32. The system of embodiment 31, wherein the valve controller is configured to regulate the flow of fluid through the valve to maintain the rpm at or below a preset rpm.

Embodiment 33. The system of any of embodiments 28 to 30, wherein the sensor is a voltage meter positioned to measure voltage at a voltage output of the power generation section, and wherein the operational parameter is the voltage output.

Embodiment 34. The system of embodiment 33, wherein the valve controller is configured to regulate the flow of fluid through the valve to maintain the voltage output at or below a preset voltage.

Embodiment 35. The system of any of embodiments 28 to 34, wherein the valve controller comprises a processor, a computer readable storage medium, and processor-executable instructions stored in the computer readable storage medium to instruct the valve controller to open, partially open, close, or partially close the valve for regulating flow of fluid into the turbine in response to data from the sensor.

Embodiment 36. The system of embodiment 35, wherein the processor-executable instructions include instructions that instruct the processor to receive sensor data from the sensor.

Embodiment 37. The system of embodiment 35, wherein the processor-executable instructions include instructions that instruct the processor to store sensor data from the sensor within the computer readable storage medium.

Embodiment 38. The system of embodiment 35, wherein the processor-executable instructions include instructions that instruct the processor to compare sensor data from the sensor to a preset operational parameter limit.

Embodiment 39. The system of embodiment 37, wherein the processor-executable instructions include instructions that instruct the processor to fully open, partially open, fully close, or partially close the flow-controlled valve in response to the comparison.

Embodiment 40. A system for controlling fluid flow into a power generation section of a tool string, the system including: a computer readable storage medium; and processor-executable instructions stored in the computer readable storage medium to instruct a processor to open, partially open, close, or partially close a valve for regulating flow of fluid into a turbine in response to data from a sensor.

Embodiment 41. The system of embodiment 40, wherein the processor-executable instructions include instructions that instruct the processor to receive sensor data from the sensor.

Embodiment 42. The system of embodiment 40, wherein the processor-executable instructions include instructions that instruct the processor to store sensor data from the sensor within the computer readable storage medium.

Embodiment 43. The system of embodiment 40, wherein the processor-executable instructions include instructions that instruct the processor to compare sensor data from the sensor to a preset operational parameter limit.

Embodiment 44. The system of embodiment 43, wherein the processor-executable instructions include instructions that instruct the processor to fully open, partially open, fully close, or partially close the flow-controlled valve in response to the comparison.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the processes, machines, manufactures, apparatus, systems, compositions of matter, means, methods and steps described in the specification. As one of ordinary skill in the art will readily appreciate from the disclosure, processes, machines, manufactures, apparatus, systems, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufactures, apparatus, systems, compositions of matter, means, methods, or steps.

What is claimed is:

1. A method for controlling fluid flow into a power generation section of a tool string, comprising:

providing multiple flow kits that are fluidly coupled with a single turbine, the multiple flow kits including at least a first flow kit, a second flow kit, and a third flow kit wherein a valve is coupled with each flow kit; and regulating flow of fluid into the turbine by opening the valve coupled with the first flow kit and maintaining the valve coupled with the second flow kit and the third flow kit closed, such that the fluid flows through the first flow kit and into the turbine, wherein the turbine is coupled with and drives a generator, and wherein the generator generates electricity, and wherein each flow kit is configured to regulate fluid flow at different flow rates from other flow kits.

2. The method of claim 1, further comprising transmitting the electricity generated by the generator through one of an active and passive rectification component to convert alternating current from the generator to direct current.

3. The method of claim 1, further comprising closing the valve coupled with the first flow kit and opening the valve coupled with the second flow kit, such that the fluid flows through the second flow kit and into the turbine.

4. A system for controlling fluid flow into a power generation section of a tool string, comprising:

a turbine coupled with a generator;

multiple flow kits fluidly coupled with the turbine, the multiple flow kits including at least a first flow kit, a second flow kit, and a third flow kit wherein a valve is coupled with each flow kit and wherein each flow kit is configured to regulate fluid flow at different flow rates from other flow kits; and a valve controller coupled with each valve, wherein the valve controller is configured to open and close each valve for regulating flow of fluid into the turbine.

5. The system of claim 4, further comprising one of an active and passive rectification component positioned to receive electricity generated by the generator through one of an active and passive rectification component and convert alternating current from the generator to direct current.

6. The system of claim 4, wherein the first flow kit is configured to provide fluid into the turbine at a first flow rate when the valve coupled with the first flow kit is opened, wherein the second flow kit is configured to provide fluid into the turbine at a second flow rate when the valve coupled with the second flow kit is opened, and wherein the first flow rate is different than the second flow rate.

7. The system of claim 4, wherein the valve controller comprises a processor in communication with a computer readable storage medium, and processor-executable instructions stored in the computer readable storage medium.

* * * * *